US009850029B2

(12) United States Patent
Brunner

(10) Patent No.: US 9,850,029 B2
(45) Date of Patent: Dec. 26, 2017

(54) CANTILEVER BOX

(71) Applicant: KETER PLASTIC LTD., Herzelyia (IL)

(72) Inventor: Yaron Brunner, Timrat (IL)

(73) Assignee: KETER PLASTIC LTD., Herzelyia (IL)

( * ) Notice: Subject to any disclaimer, the term of this patent is extended or adjusted under 35 U.S.C. 154(b) by 262 days.

(21) Appl. No.: 14/655,464

(22) PCT Filed: Dec. 24, 2013

(86) PCT No.: PCT/IL2013/051063
§ 371 (c)(1),
(2) Date: Jun. 25, 2015

(87) PCT Pub. No.: WO2014/102783
PCT Pub. Date: Jul. 3, 2014

(65) Prior Publication Data

US 2015/0353231 A1 Dec. 10, 2015

Related U.S. Application Data

(60) Provisional application No. 61/745,948, filed on Dec. 26, 2012.

(51) Int. Cl.
*B65D 21/02* (2006.01)
*B65D 1/34* (2006.01)
(Continued)

(52) U.S. Cl.
CPC ..... *B65D 21/0226* (2013.01); *B25H 3/023* (2013.01); *B65D 1/34* (2013.01);
(Continued)

(58) Field of Classification Search
CPC ..... B65D 21/0226; B65D 21/0217; B65D 21/0209; B65D 21/0235; B65D 43/14;
(Continued)

(56) References Cited

U.S. PATENT DOCUMENTS 1,882,756 A * 10/1932 Boynton ..... B25H 3/023 190/17
2,361,079 A * 10/1944 Berry ..... B25H 3/023 312/244

(Continued)

FOREIGN PATENT DOCUMENTS

BE 449898 A 5/1943
EP 1 859 908 A1 11/2007
GB 2 086 851 A 5/1982

*Primary Examiner* — Steven A. Reynolds
*Assistant Examiner* — Javier A Pagan
(74) *Attorney, Agent, or Firm* — Vorys, Sater, Seymour & Pease LLP

(57) ABSTRACT

Provided is a cantilever box including at least two trays, including a lowermost tray and an uppermost tray, interconnected therebetween by cantilever links pivotally secured to the trays, the trays are convertible at least between a stacked position, and an extended position; a first gripping portion, disposed at the uppermost tray, configured for being gripped by a user for converting the trays between their extended position and their stacked position; and a securing mechanism switchable between a locked state in which when the trays are at their extended position, the securing mechanism is configured for arresting a locking member, thereby locking the trays at their extended position; and an unlocked state in which the securing mechanism is disengaged from said locking member, thereby facilitating displacement of the trays from their extended position into their stacked position.

25 Claims, 10 Drawing Sheets

(51) Int. Cl.
*B65D 25/30* (2006.01)
*B65D 43/16* (2006.01)
*B25H 3/02* (2006.01)

(52) U.S. Cl.
CPC ..... *B65D 21/0235* (2013.01); *B65D 25/30* (2013.01); *B65D 43/16* (2013.01)

(58) Field of Classification Search
CPC . B65D 43/16; B25H 3/00; B25H 3/02; B25H 3/021; B25H 3/022; B25H 3/023
USPC ..... 206/736, 740, 741, 742, 743
See application file for complete search history.

(56) References Cited

U.S. PATENT DOCUMENTS 2,374,037 A * 4/1945 Piker ..... B25H 3/023 312/266
2,488,067 A * 11/1949 Roark ..... B25H 3/023 190/30
3,985,409 A * 10/1976 Kneier ..... A45C 13/02 312/266
4,621,308 A * 11/1986 Holmberg ..... A01K 97/06 206/315.1
7,278,234 B2 * 10/2007 Marino ..... A01K 97/22 206/315.11

* cited by examiner

CANTILEVER BOX

TECHNICAL FIELD

The presently disclosed subject matter relates to boxes, and more particularly to boxes having a cantilever mechanism.

The term 'cantilever box' as used herein the specification and claims denotes a box (e.g., a toolbox, a tackle box) in which a cantilever mechanism connecting a plurality of trays, is implemented.

BACKGROUND

Cantilever boxes of different sizes and constructions are well known in the art. One well known type of a cantilever box is a tackle box. Cantilever boxes generally comprises a plurality of compartmentalized trays and linkage elements interconnecting the trays so that they can be moved from a superimposed stacked condition to an expanded cantilevered condition in which the trays are vertically offset whereby access can be obtained to each tray. The trays are designed to receive and store various tools, such as working tools, screws, nuts, small boxes, etc.

Cantilever boxes are basically designed to allow the storage of numerous items of varying size and shape in a convenient and orderly manner which provides maximum access to the items contained.

SUMMARY OF THE PRESENTLY DISCLOSED SUBJECT MATTER

According to the presently disclosed subject matter, there is provided a cantilever box comprising:

at least two trays, including a lowermost tray and an uppermost tray, interconnected therebetween by cantilever links pivotally secured to said trays. The trays are convertible at least between a stacked position, and an extended position;

a first gripping portion, disposed at the uppermost tray, configured for being gripped by a user for converting the trays between their extended position and their stacked position; and a securing mechanism switchable between a locked state in which when the trays are at their extended position, the securing mechanism is configured for arresting a locking member, thereby locking the trays at their extended position; and an unlocked state in which the securing mechanism is disengaged from said locking member, thereby facilitating displacement of the trays from their extended position into their stacked position;

The securing mechanism is disposed in proximity to the first gripping portion, or integrated therein, so that the user is required to switch the securing mechanism from its locked state to its unlocked state by his first hand while gripping the first gripping portion by the same hand, thereby displacing the uppermost tray for converting the trays from their extended position to their stacked position.

The first gripping portion and the securing mechanism are located at a safe location in the cantilever box, i.e., at the uppermost tray, which allows the user to convert the trays from their extended position to their stacked position in a controlled and a safe manner. This manner eliminates or reduces the likelihood of jamming the fingers of the user's first hand between the trays during the conversion between the positions.

The uppermost tray can be configured with a top wall, a front wall and a bottom wall. The top wall and the front wall are configured with a front edge therebetween, having a longitudinal axis.

The first gripping portion can be disposed at the middle of the front edge along its longitudinal axis.

Alternatively, the first gripping portion can be disposed at the top wall of the uppermost tray.

The securing mechanism can be disposed at the front wall of the uppermost tray.

The first gripping portion can have a first gripping recess disposed at the top wall of the uppermost tray.

The first gripping recess can be configured with shape and size for accommodating one or more of the following fingers of the user's first hand: index finger, middle finger, ring finger, and little finger.

The cantilever box can further include a cover member.

The cover member can be pivotally mounted to the uppermost tray and constitutes a portion of its top wall.

The first gripping recess can be disposed at the cover member.

The securing mechanism can be normally in its locked state.

The term 'normally' refers herein to usually, or most of the time.

The securing mechanism can comprise a sliding element having a first end configured with a biasing mechanism for outwardly biasing the sliding element by exerting thereon an outwardly biasing force and thereby causing it to be normally in its locked state; and a second end including a securing protrusion configured with a front face.

The first gripping portion can be configured with an interior section, which together with the sliding element constitutes the securing mechanism.

The sliding member can further comprise a middle portion configured with a thumb supporting element configured to provide support to a thumb of the user's first hand when switching the securing mechanism from its locked state to its unlocked state by applying an inwardly biasing force on the thumb supporting element.

The securing protrusion can be configured to be received at the locking member, and thereby arresting the locking member in the locked state of the securing mechanism.

The securing protrusion can normally project out of the surface of the bottom wall of the uppermost tray.

In the configuration in which the sliding element is disposed at an interior section of the first gripping portion, the interior section can be configured with a biasing wall configured for engaging the biasing mechanism and providing support thereto for exerting the outwardly biasing force on the sliding element.

The biasing mechanism can include at least one bendable element.

The biasing mechanism can include two bendable elements, the ends of which are configured to move away from each other and to slide on the biasing wall when the securing mechanism is switched from its normally locked state to its unlocked state.

The ends of the bendable elements are further configured to approach each other and to slide on the biasing wall when the securing mechanism is switched from its unlocked state to its normally locked state.

The biasing mechanism can be a compression spring.

The sliding element and the biasing mechanism can be integrated in a single element.

The sliding element and the biasing mechanism can be made of the same material.

The cantilever box can further comprise a second gripping portion, disposed at the lowermost tray, configured for being gripped by a user's second hand for providing support to the cantilever box and holding it on place, when the trays are converted between their extended position and their stacked position.

The second gripping portion is located at a safe location in the cantilever box, i.e., at the lowermost tray, which allows the user to convert the trays between their extended position and their stacked position in a controlled and a safe manner. This manner eliminates or reduces the likelihood of jamming the fingers of the user's second hand between the trays during the conversion between the positions.

The lowermost tray can be configured with a front wall at which the second gripping portion can be disposed.

The second gripping portion can be configured with a second gripping recess configured with shape and size for accommodating one or more of the following fingers of the user's second hand: index finger, middle finger, ring finger, and little finger.

The second gripping portion can further be configured with a second gripping supporting surface configured for providing support to a palm and a thumb of the user's second hand.

The locking member can be disposed at one of the trays. More particularly, the locking member can be disposed at a secondary tray below the uppermost tray.

The secondary tray can be configured with a top wall and a rear wall, configured with a rear edge therebetween, having a longitudinal axis. The locking member can be disposed in the middle of the rear edge along said longitudinal axis.

Alternatively, the locking member can be disposed at one of the cantilever links.

The locking member can be a recess or any other fixing element which is configured to engage with the securing mechanism, and thereby to be arrested by the securing mechanism in its locked state.

The secondary tray can be configured with a biasing protrusion configured to engage the front face of the securing protrusion for exerting an inwardly biasing force on the sliding element during the conversion of the trays from the stacked position to their extended position.

The biasing protrusion can project out of the surface of the top wall of the secondary tray.

In the process of the conversion of the trays from their stacked position to their extended position, the biasing protrusion can switch the securing mechanism from its normally locked state to its unlocked state upon the exertion of the inwardly biasing force on the sliding element, and then switching back to its normally locked state upon the exertion of the outwardly biasing force when it is greater than said inwardly biasing force.

The trays can include more than two trays, each of which is connected to at least two other trays by the cantilever links for allowing simultaneous displacement of the trays not including the lowermost tray, when converted between the stacked position and the extended position. Due to this simultaneous displacement, by arresting the securing mechanism to the locking member, all the trays can be locked in their extended position.

When the trays are at their stacked position, the securing mechanism can further be switchable between a locked state in which the securing mechanism is configured for arresting another locking member, thereby locking the trays at their stacked position; and an unlocked state in which the securing mechanism is disengaged from said another locking member, thereby facilitating displacement of the trays from their stacked position into their extended position.

The cantilever box can further comprise at least one latch configured for locking the trays at their stacked position.

The at least one latch can be pivotally mounted to the lowermost tray at a mounting portion.

The cover member can be configured with at least one first engagement portion and the mounting portion can be configured with at least one second engagement portion. When the cover is in its closed state, the latch can be mounted to the first and the second engagement portions, thereby locking the trays at their stacked position so that the uppermost tray and the middle tray are fixed between the cover member and the lowermost tray.

The cantilever box can further comprise at least one handle mounted to an uppermost tray of the trays. The handle can be used for holding and transporting the cantilever box from place to place. The handle can further be used for converting the trays from their stacked position to their extended position.

The cantilever box can further include at least one supporting element, mounted to one of the trays, configured, at the extended position of the trays, for leaning on a surface on which said cantilever box is disposed, and thereby preventing the cantilever box from rolling over.

BRIEF DESCRIPTION OF THE DRAWINGS

In order to understand the invention and to see how it can be carried out in practice, the embodiments will now be described, by way of non-limiting examples only, with reference to the accompanying drawings, in which.

DETAILED DESCRIPTION OF EMBODIMENTS

Figure 1:
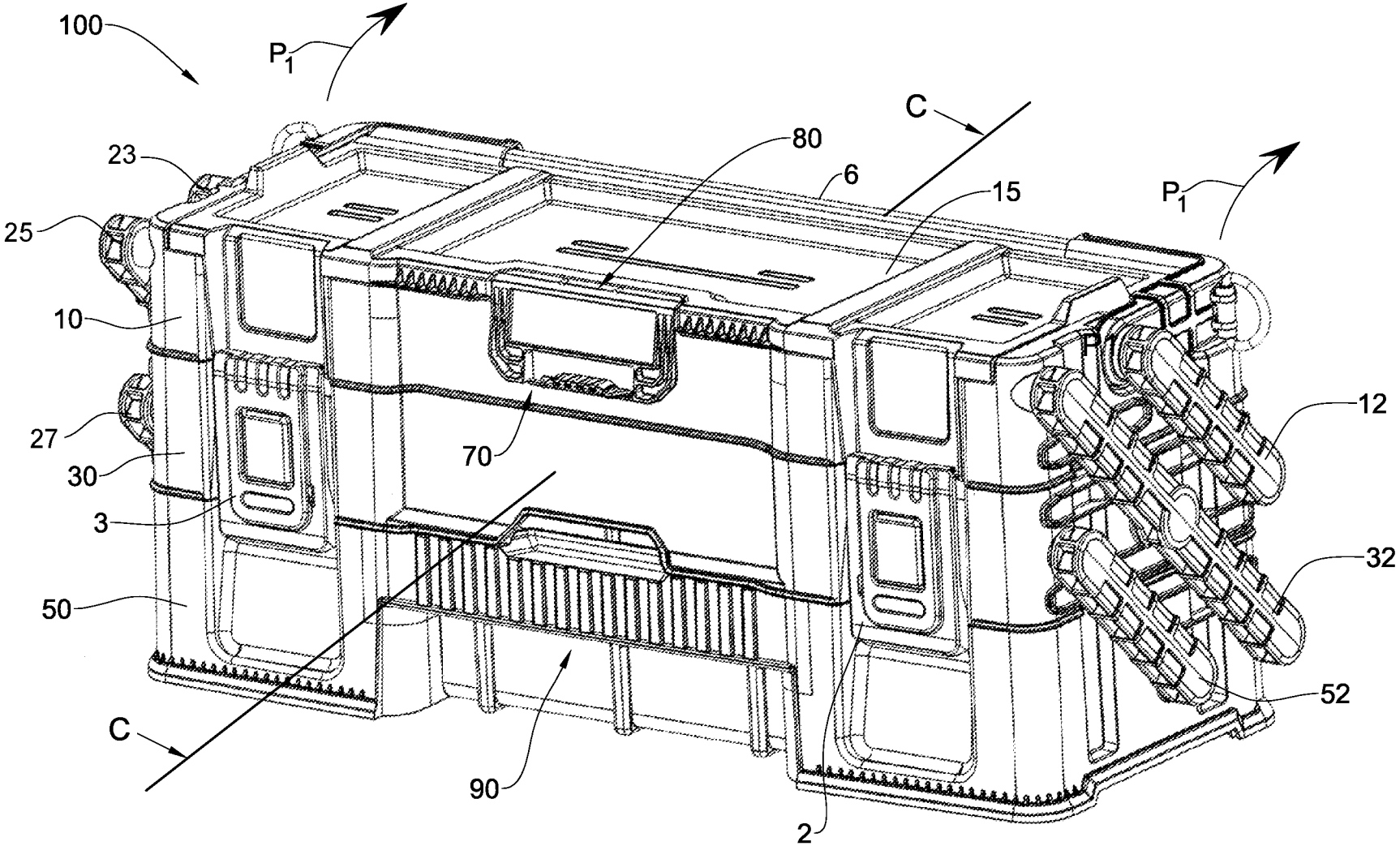
FIG. 1 is a perspective view of a cantilever box in its stacked position, in accordance with one example of the presently disclosed subject matter.
Figure 2:
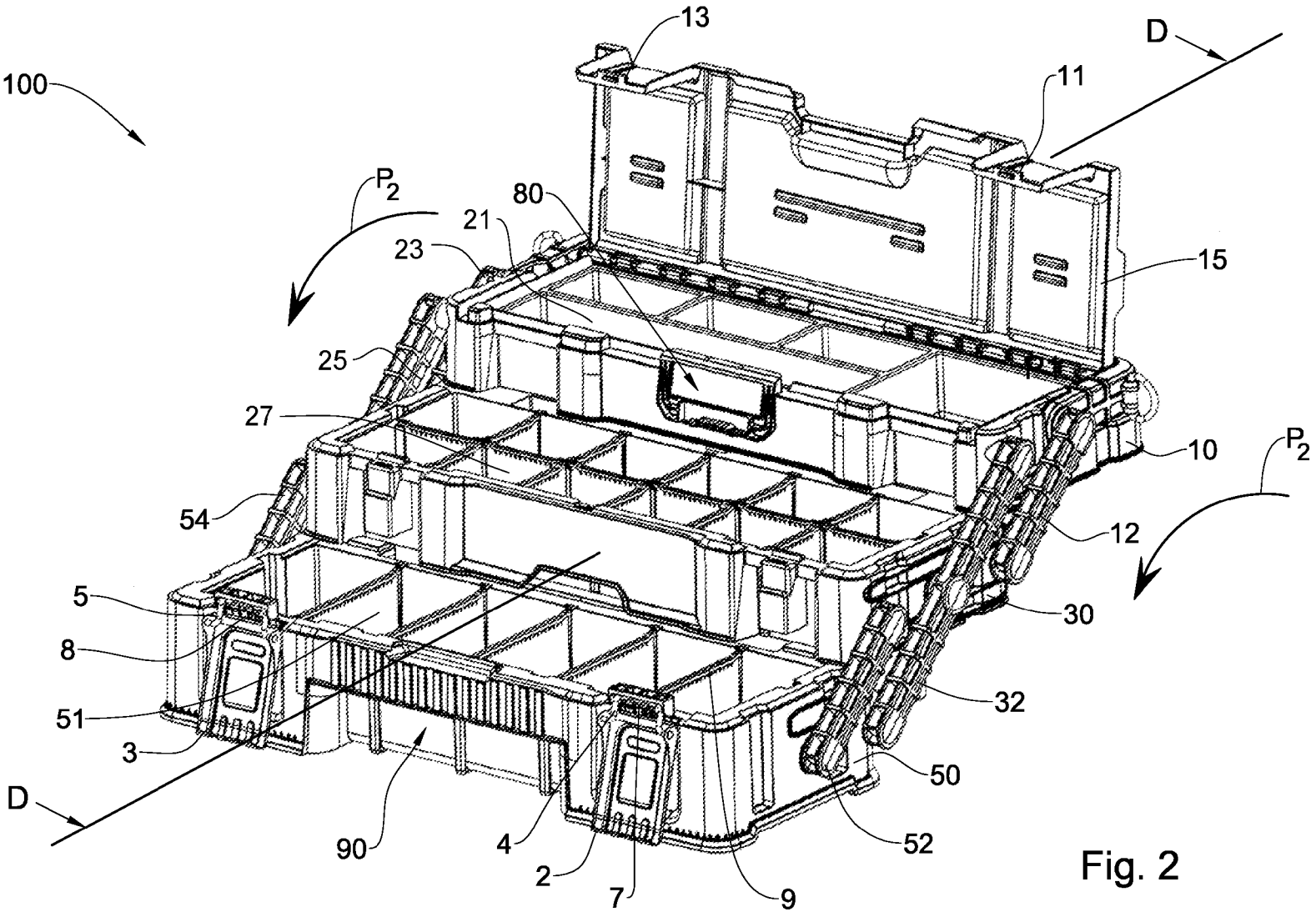
FIG. 2 is the cantilever box of FIG. 1 in its extended position.

Attention is first directed to FIGS. 1 and 2 of the drawings illustrating a cantilever box in accordance with one example of the presently disclosed subject matter, generally designated 100. The cantilever box comprises three trays as follows: an uppermost tray 10, a middle tray 30 and a lowermost tray 50. The trays of the cantilever box 100 are interconnected therebetween by cantilever links, which are pivotally secured to the sidewalls of the trays as follows: a cantilever link 12 and a cantilever link 23 connect the uppermost tray 10 with the middle tray 30, a cantilever link 32 and a cantilever link 25 connect the uppermost tray 10 with the middle tray 30 and the lowermost tray 50, and a cantilever link 52 and a cantilever link 27 connect the middle tray 30 with the lowermost tray 50.

The trays 10, 30 and 50 have interior storage spaces 21, 31 and 51 therein, respectively, in which tools and other goods can be stored. The interior storage spaces 21, 31 and 51 can be divided to sub-sections by different dividers such as a divider 9 of the lowermost tray 50.

Figure 5A:
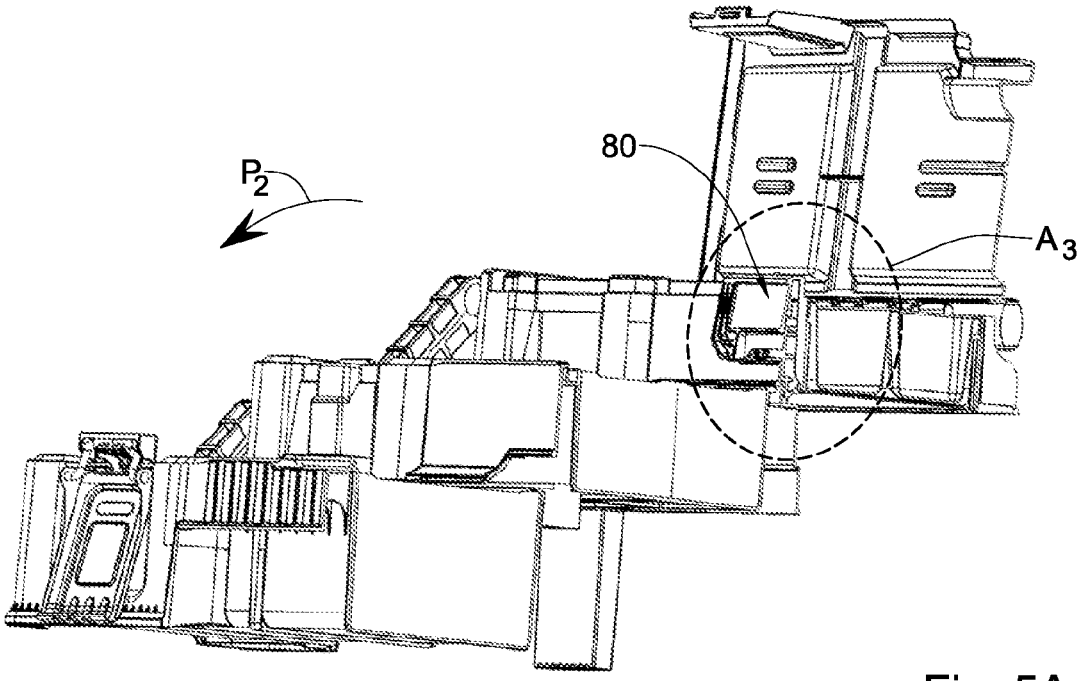
FIG. 5A is a cross-section along line D-D in FIG. 2.
Figure 5B:
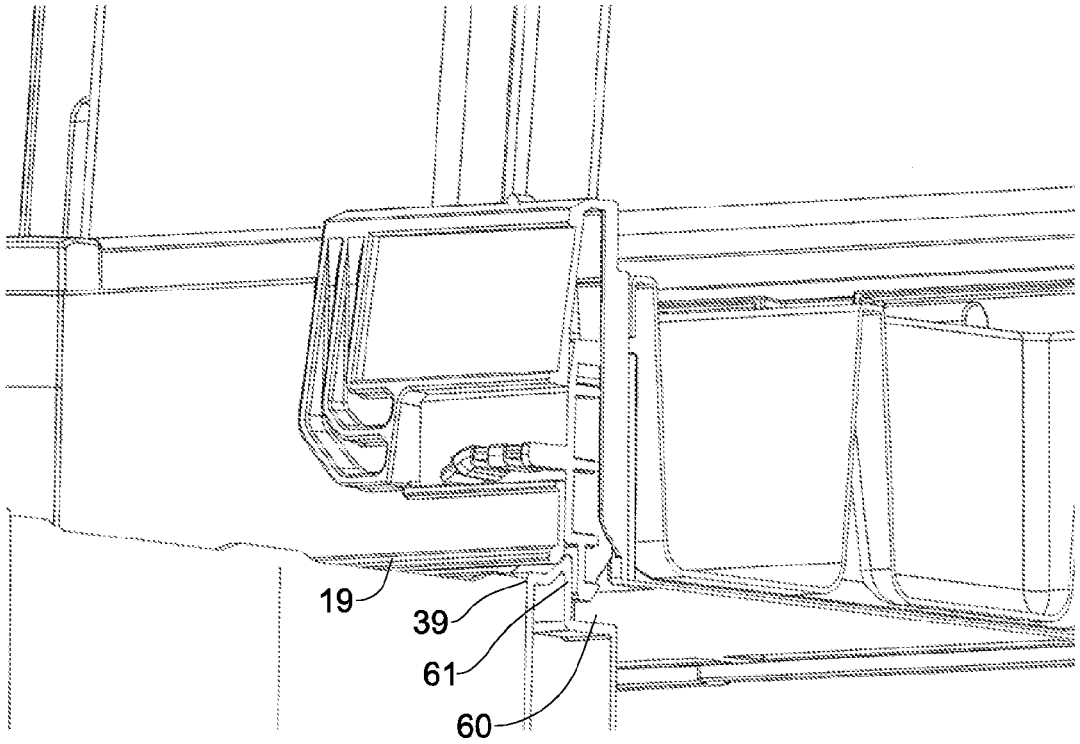
FIG. 5B is an enlarged view of a portion A3 of FIG. 5A.
Figure 5C:
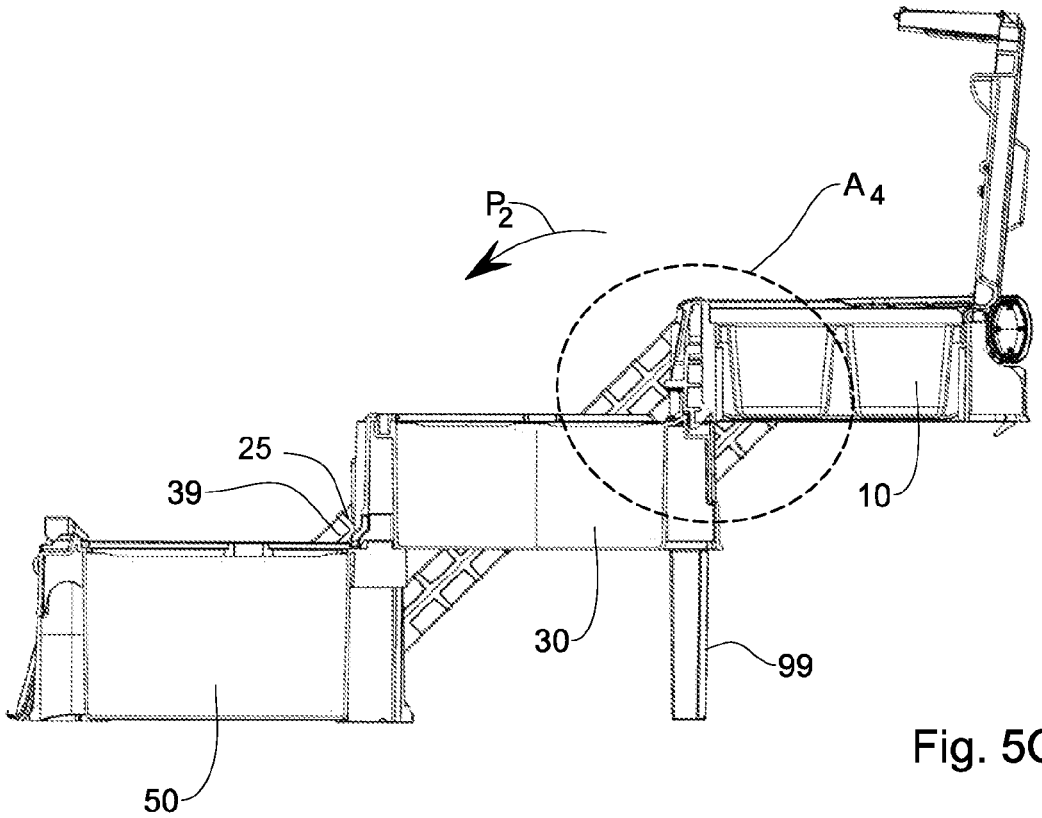
FIG. 5C is a side view of FIG. 5A.
Figure 5D:
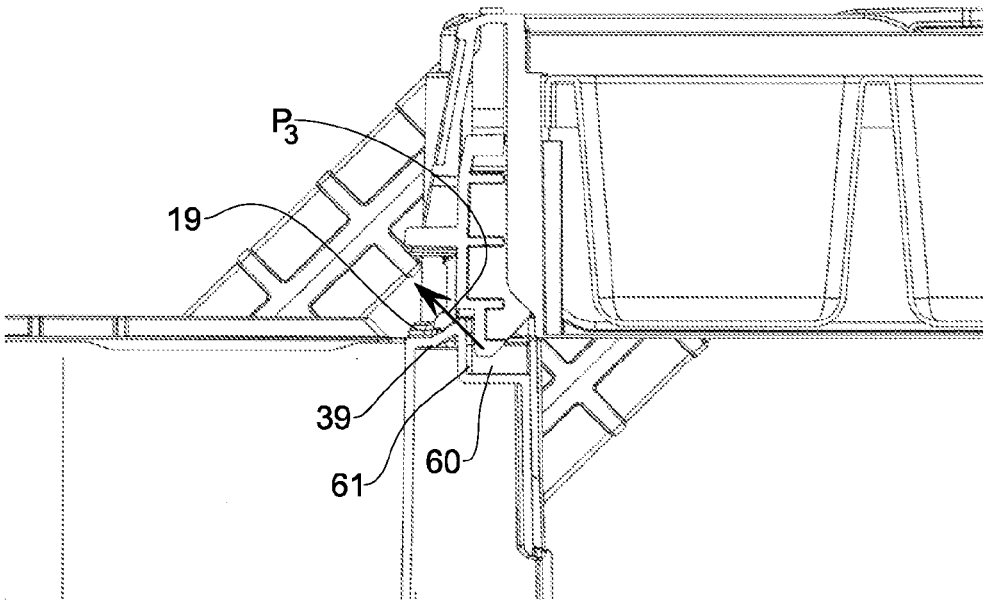
FIG. 5D is an enlarged view of a portion A4 of FIG. 5C.

The trays 10, 30 and 50 are convertible between a stacked position (shown in FIG. 1), and an extended position (shown in FIGS. 2, 5A and 5C). By converting the trays 10, 30 and 50 from the stacked position to the extended position, the content of the interior storage spaces 31 and 51 can be exposed to the user.

The cantilever box 100 includes a cover 15 which is pivotally articulated to the uppermost tray 10. In FIG. 1 the cover 15 is illustrated in its closed state and in FIG. 2 the cover 15 is illustrated in its open state. The cover has first engagement portions 11 and 13.

The cantilever box 100 further includes two latches 2 and 3 which are configured for locking the trays at their stacked position by fixing the uppermost tray 10 to the lowermost tray 50.

The latches 2 and 3 are povitally mounted to the lowermost tray 50 at mounting portions 4 and 5, respectively (shown in FIG. 2). The mounting portions 4 and 5 have second engagement portions 7 and 8, respectively.

When the cover 15 is in its closed state, the latch 2 is mounted to the first and the second engagement portions 11 and 7, respectively, and the latch 3 is mounted to the first and the second engagement portions 13 and 8, respectively. This mounting of the latched 2 and 3 locks the trays at their stacked position so that the uppermost tray 10 and the middle tray 30 are fixed between the cover member 15 and the lowermost tray 50.

The cantilever box 100 has a handle 6 pivotally mounted to the uppermost tray 10. The handle 6 can be used for holding and transporting the cantilever box 100 from place to place when the latches 2 and 3 lock the trays at their stacked position.

When the latches do not fix the uppermost tray 10 to the lowermost tray 50, the trays can be converted from their stacked position to their extended position. This can be performed by a user-actuated pulling force applied on the uppermost tray 10 in the direction of arrow $P_1$ (shown in FIGS. 1 and 4A) by one or two hands of the user. This pulling force can be applied on the handle 6 or on the uppermost tray 10.

The cantilever box 100 further has two supporting elements 99 (shown in FIG. 5C), mounted to the bottom wall of middle tray 30 and configured, at the extended position of the trays, for leaning on a surface on which the cantilever box 100 is disposed, and thereby preventing the cantilever box 100 from rolling over.

In general, one way of converting the trays from their extended position to their stacked position is by applying a user-actuated pulling force on the uppermost tray 10 in the direction of arrow $P_2$ (shown in FIG. 2) by a first hand of the user, while his second hand supports the lowermost tray 50 and provides contra to the pulling force.

In order to eliminate or reduce the likelihood of jamming the user's fingers between the trays (e.g., between the middle tray and the lowermost tray) during the conversion of the trays from their extended position and the stacked position (e.g. by applying a user-actuated pulling force on the middle tray 30 instead of on the uppermost tray 10 in the direction $P_2$), it is important to lock the trays in the extended position, and to allow unlocking them from the extended position and converting them to the stacked position is a controlled and a safe manner. This controlled and safe manner includes forcing the user to locate his first hand (that actuates the pulling force in the direction $P_2$) in a specific location at the uppermost tray 10, and his second hand (that supports the lowermost tray and provides contra to the pulling force) in a specific location at the lowermost tray 50.

For this reason, the cantilever box 100 is provided with a first gripping portion 80 which, as detailed below, is disposed at a specific safe location at the uppermost tray 10. The first gripping portion 80 is configured for being gripped by the first hand of the user for converting the trays from their extended position to their stacked position.

In addition, the first gripping portion 80 includes a securing mechanism 70 responsible for locking and unlocking the trays at their extended position. The securing mechanism 70 is switchable between a normally locked state (shown, for example, in FIGS. 1 and 2) and an unlocked state (not shown), each of which is detailed below.

The securing mechanism 70 is integrated within the first gripping portion 80, so that the user is required to switch the securing mechanism 70 from its normally locked state to its unlocked state by his first hand while gripping the first gripping portion by the same hand, thereby displacing the uppermost tray 10 for converting the trays 10, 30 and 50 from their extended position to their stacked position.

The integration of the securing mechanism 70 in the first gripping portion 80 forces the user that converts the trays from their extended position into their stacked position, to locate his first hand at the first gripping portion 80 because the trays must be unlocked from their extended position via the securing mechanism 70 before the actuation of the pulling force on the uppermost tray 10 in the direction $P_2$.

In addition, the cantilever box 100 is provided with a second gripping portion 90 which is disposed at a specific safe location in the lowermost tray 10, as detailed below with respect to FIGS. 3H and 3I. The second gripping portion 90 is configured for providing space to the second hand of the user that supports the lowermost tray 50 and provides contra to the pulling force.

The fact that each one of the tray 10, 30 and 50 is connected by respective cantilever links to the other two trays results in an arrangement according to which the trays are convertible between the stacked position and the extended position in a simultaneous manner. According to this arrangement of the cantilever box 100, the middle tray 30 cannot be displaced without displacement of the uppermost tray 10, and vice versa. Therefore, by arresting the uppermost tray 30 with respect to another element of the cantilever box 100, i.e., a locking member, in the extended position thereof, all the trays will be locked in this position. According to the present example, the securing mechanism 70 arrests a locking member in the form of a first recess 60 disposed at the middle tray 30 (shown in FIGS. 5A to 5D), thereby locking the trays at their extended position.

When the trays are converted from their stacked position to their extended position, due to its structure, the securing mechanism 70 is configured for automatically locking the trays at this position. This automatic manner of operation is explained below.

When the trays are disposed at their extended position, the securing mechanism 70 is in its normally locked state in which it arrests the first recess 60, thereby locking the trays at this position. A detailed explanation of the extended position of the cantilever box 100 is detailed below with respect to FIGS. 5A to 5D.

When the trays are at their stacked position shown in FIG. 1, the securing mechanism 70 is in its normally locked state, but in this position the trays are not locked. A detailed explanation of the stacked position of the cantilever box 100 is detailed below with respect to FIGS. 4A and 4B.

When the trays are at their extended positions, by being switched to its unlocked state, the securing mechanism 70 disengages the first recess 60, thereby unlocking the trays from their extended position, and facilitating displacement of the trays from their extended position to their stacked position.

Reference is now made to FIGS. 3A to 3E, in which the first gripping portion 80 and the securing mechanism 70 are presented in a detailed manner. FIGS. 3A to 3E illustrate an example of a safe location at which first gripping portion 80 and the securing mechanism 70 can be disposed in the cantilever box 100. This safe location allows the user to convert the trays from their extended position to their stacked position in a controlled and a safe manner, which eliminates or reduces the likelihood of jamming the fingers of the user's first hand between the trays during the conversion between the positions.

Figure 3A:
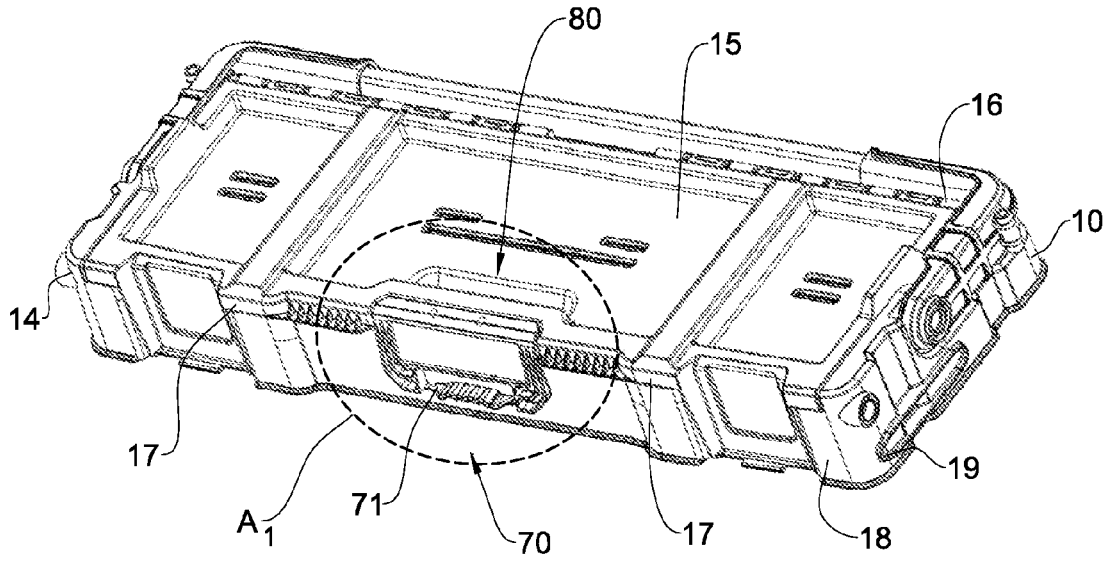
FIG. 3A is a perspective view of an uppermost tray of the cantilever box of FIGS. 1 and 2.

As shown in FIG. 3A, the uppermost tray 10 has a top wall 16, a front wall 18, a bottom wall 20, an upper perimetric edge 14 and a perimetric bottom edge 19. The top wall 16 includes the cover 15. The top wall 16 and the front wall 18 are configured with a front edge 17 therebetween. The front edge 17 constitutes a portion of the top edge 14. The first gripping portion 80 is disposed at a portion of the top wall 16 and at a portion of the front wall 18. Moreover, the first gripping portion 80 is disposed at the middle of the front edge 17, so that the line A-A, which is taken at the middle of the uppermost tray, passes in the middle of the first gripping portion 80. The first gripping portion 80 is disposed in the middle of the front edge 17 so that when gripped and pulled by the user, a substantially equal and symmetrical force will be applied to the uppermost tray 10.

Figure 3B:
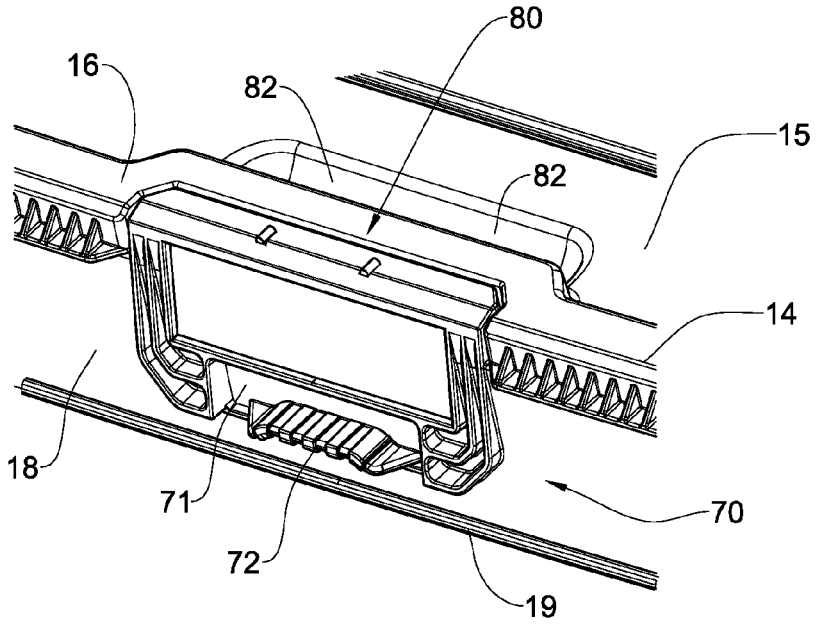
FIG. 3B is an enlarged view of a portion A1 of FIG. 3A.
Figure 3C:
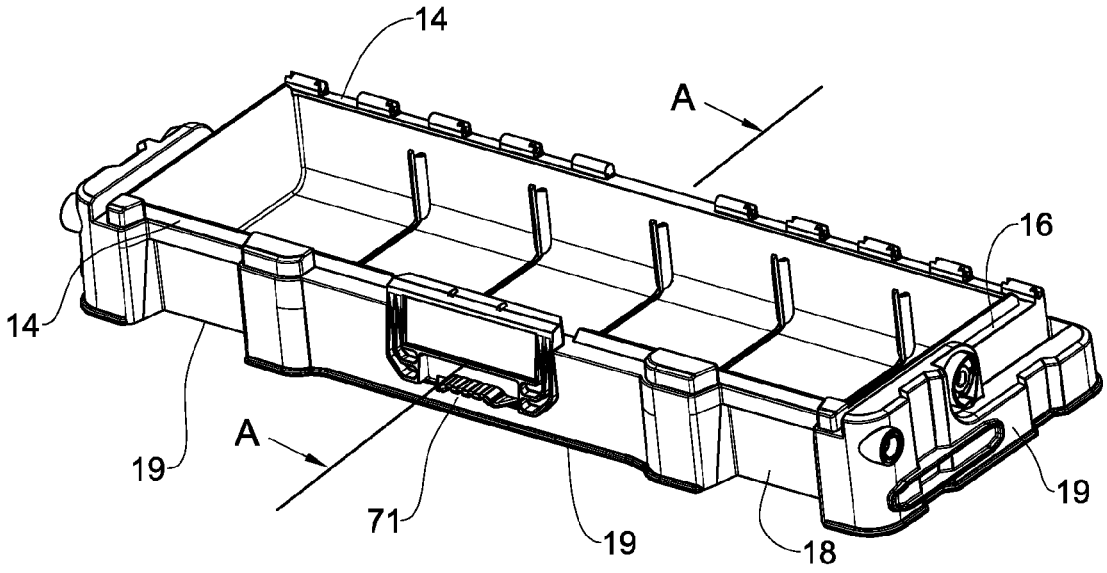
FIG. 3C is the uppermost tray of FIG. 3A without a cover member and a handle of the cantilever box.

As shown in FIG. 3B, in which an enlarged view of the first gripping portion 80 is presented, the first gripping portion 80 includes a first gripping recess 82 which is formed within the cover 15, and it includes the securing mechanism 70 that is formed within a portion of the front wall 18. The first gripping portion 80 is configured to be gripped by a first hand of the user, and particularly by five fingers of this hand. In particular, the first gripping recess 82 is configured to be gripped by the following four fingers of the user's first hand: the index finger, the middle finger, the ring finger, and the little finger. The securing mechanism 70 is configured to be gripped by the fifth finger, i.e., the thumb, as detailed below with respect to FIG. 3E. As shown in FIG. 3B, the first gripping recess 82 is characterized by shape and size which allow accommodation of the above four fingers along the length of the first gripping recess 82. It should be indicated that although the first gripping recess 82 is configured to accommodate all the four fingers, not all of them are always required for the gripping and the pulling of the first gripping portion 80. In addition, since the first gripping recess 82 is formed within the cover 15, when the cover is in its open state, an internal portion 85 (shown in FIG. 3D) can be used instead of the first gripping recess 82 for accommodating the above four fingers therein.

The first gripping portion 80 further includes an interior section 84 (shown in FIG. 3D) which, together with a sliding element 71 constitutes the securing mechanism 70.

Figure 3D:
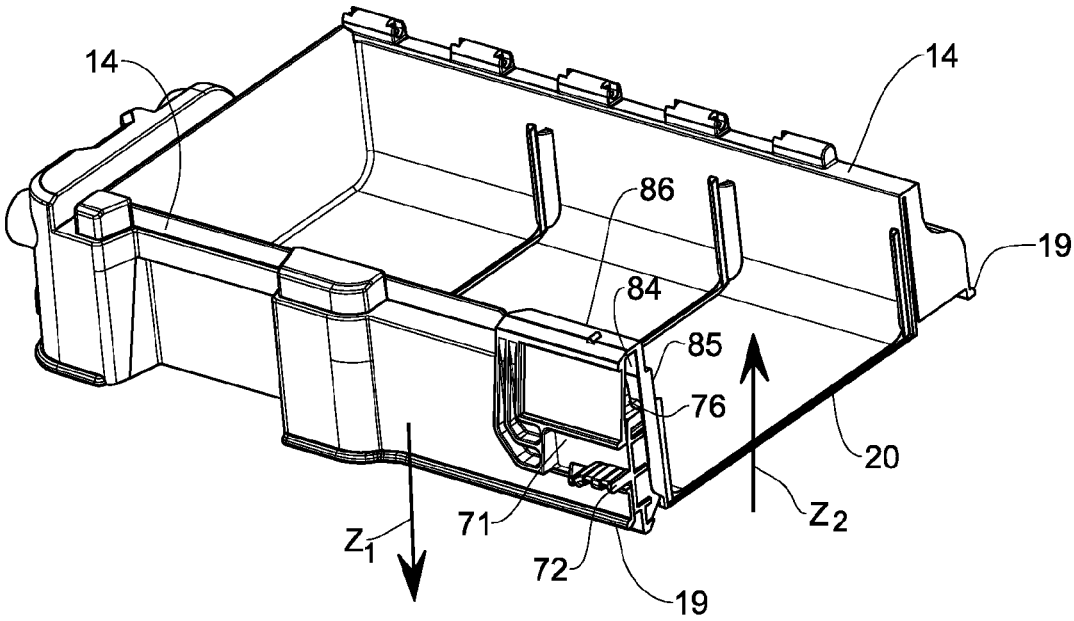
FIG. 3D is a cross-section along line A-A in FIG. 3C.
Figure 3E:
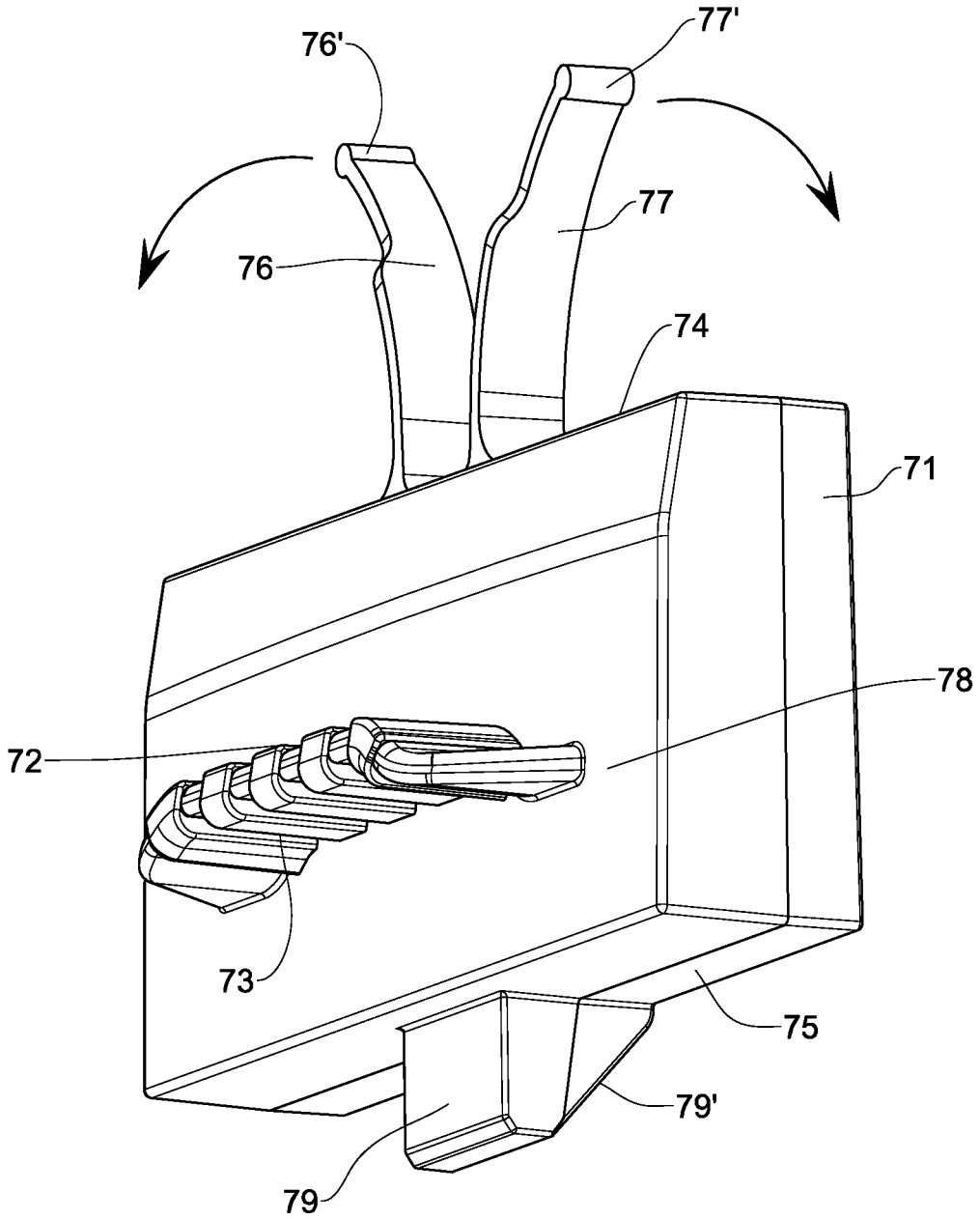
FIG. 3E is a perspective view of a sliding element of the securing mechanism of the cantilever box of FIGS. 1 and 2.

As shown in FIG. 3E, the sliding element 71 has a first end 74, a second end 75 and a middle portion 78 therebetween. The first end 74 is configured with a biasing mechanism in the form of two bendable elements 76 and 77, which act as a compression spring. The bendable elements 76 and 77 have a first end 76' and a second end 77', respectively. When the sliding element 71 is tightly received within the interior section 84, the first end 76' and the second end 77' are engaging with and supported by an upper biasing wall 86 of the interior section 84. This engagement outwardly biases the sliding element 71 in a downward direction indicated by an arrow $Z_1$ (in FIG. 3D) by exerting thereon an outwardly biasing force and thereby causing the securing mechanism to be normally in its locked state. The sliding element and the biasing mechanism can be integrated in a single element. The sliding element 71 and the bendable elements 76 and 77 are integrated in a single element and made of the same material.

The middle portion 78 includes a thumb supporting element 72 having a bottom wall 73 (shown in FIG. 3D). The bottom wall 73 is shaped so as to accommodate the fifth finger of the user's first hand, i.e., its thumb, when the first gripping portion 80 is gripped by the user's first hand.

The securing mechanism 70 is convertible from its normally locked state to its unlocked state when the sliding element 71 slides within the interior section 84 along an upward direction indicated by an arrow $Z_2$. The securing mechanism 70 can be switched from its locked state to its unlocked state upon application of an inwardly biasing force on the bottom wall 73 of the thumb supporting element 72 in the direction $Z_2$. Upon the sliding of the sliding element 71 in the direction $Z_2$, the bendable elements 76 and 77 are forced by the upper biasing wall 86 to be bent such that their ends 76' and 77' are forced to move in the directions $Z_3$ and $Z_4$, respectively while sliding along the upper biasing wall 86 and moving away from each other.

When the inwardly biasing force is ceased from being applied, the bendable elements 76 and 77 revert to their original shape, thereby forcing the sliding element 71 to slide in the direction $Z_1$, and thereby causing the securing mechanism 70 to assume its normally locked state.

The first gripping portion 80 has dimensions which are configured to fit the size of an average hand of a user. These dimensions include a reasonable distance between the thumb supporting element 72 and the first gripping recess 82.

The second end 75 has a securing protrusion 79 configured with a front face 79'. As clearly shown in FIG. 3D, in the normally locked state of the securing mechanism 70, the securing protrusion 79 protrudes out of the surface of the bottom wall 20.

The securing protrusion 79 is configured to be received within the first recess 60 of the middle tray 30, thereby locking the trays at their extended position.

Figure 3F:
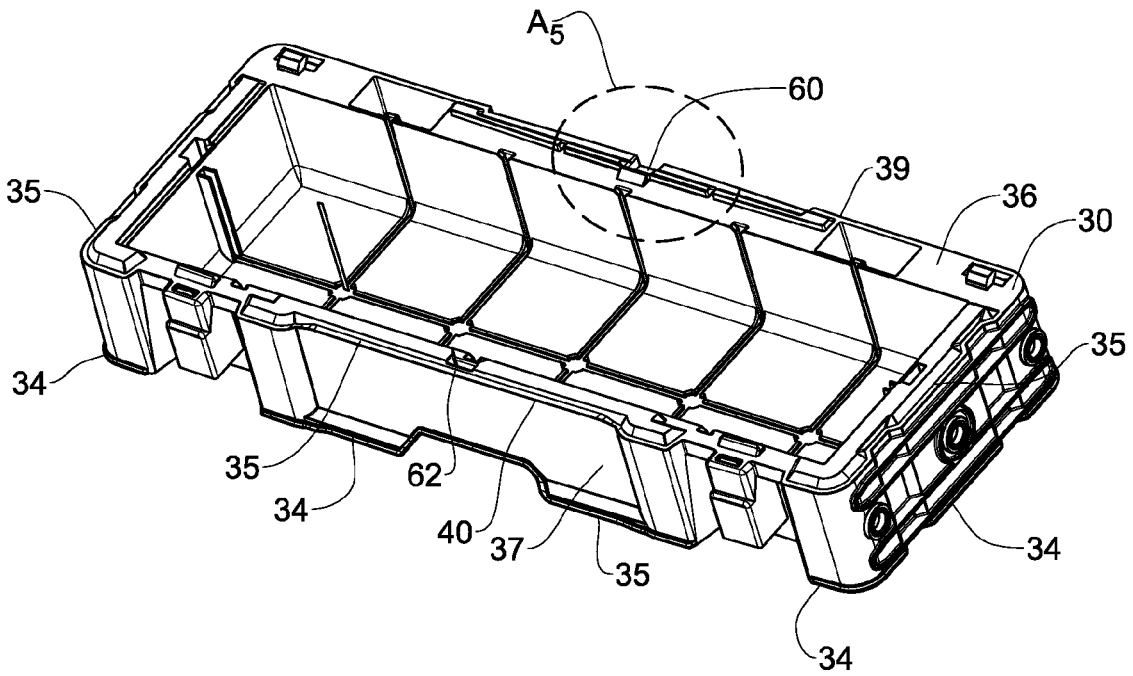
FIG. 3F is a perspective view of a secondary tray of the cantilever box of FIGS. 1 and 2.
Figure 3G:
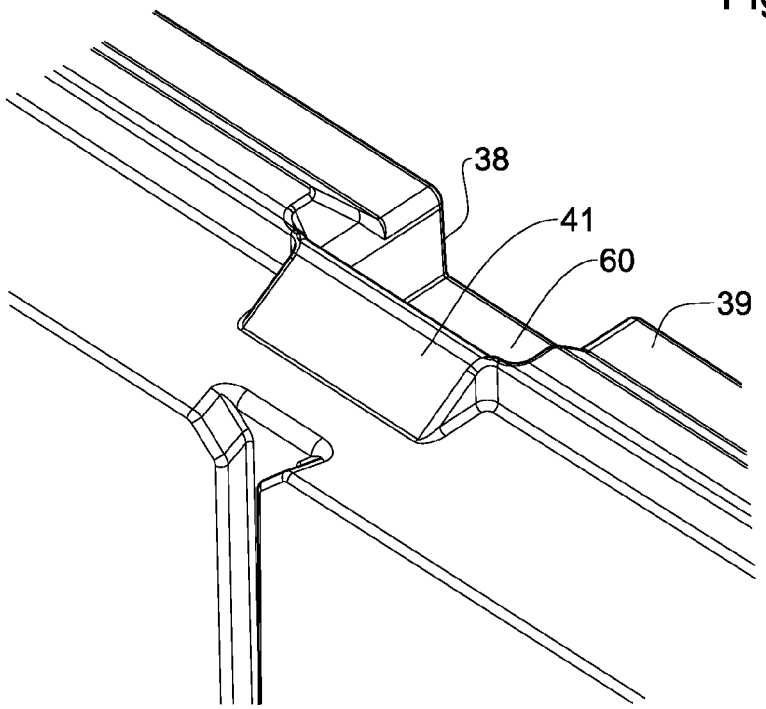
FIG. 3G is an enlarged view of a portion A5 of FIG. 5E.

Reference is now made to FIGS. 3F and 3G in which the middle tray 30 is illustrated. The middle tray 30 is configured with a top wall 36, a front wall 37, a rear wall 38, a perimetric bottom edge 34 and a perimetric top edge 35. The top wall 36 and the rear wall 38 are configured with a rear edge 39 therebetween. The rear edge 39 constitutes a portion of the top edge 35. The first recess 60 is disposed in the middle of the rear edge 39, so that when the trays are in their extended position, the first recess 60 is located underneath the first gripping portion 80, and more particularly under the securing protrusion 79. The top wall 36 and the front wall 37 are further configured with a front edge 40 therebetween. The middle tray 30 further has a second recess 62. The second recess is disposed in the middle of the front edge 40, so that when the trays are in their stacked position, the second recess 62 is located underneath the first gripping portion 80, and more particularly under the securing protrusion 79. In this position of the trays, the second recess 62 is configured to accommodate the securing protrusion 79 therein.

The middle tray 30 is further configured with a biasing protrusion 41 which protrudes out of the surface of the top wall 39. Since securing protrusion 79 and the biasing protrusion 41 protrude out of their respective trays, they engage each other during the conversion of the trays from their stacked position to their extended position. When this engagement takes place, the biasing protrusion 41 exerts an inwardly biasing force on the front face 79', and thereby on the whole sliding element 71, in the direction $Z_2$. This biasing force causes the sliding element 71 to be inwardly biased. When the front face 79' passes through the securing protrusion 79 and disengaged therefrom, the outwardly biasing force applied by the bendable elements 76 and 77 is greater than said inwardly biasing force, which causes the sliding element 71 to slide downwards to its natural state. This results in causing the securing protrusion 79 to jump into the first recess 60, thereby allowing the securing mechanism to arrest the first recess 60.

Figure 3H:
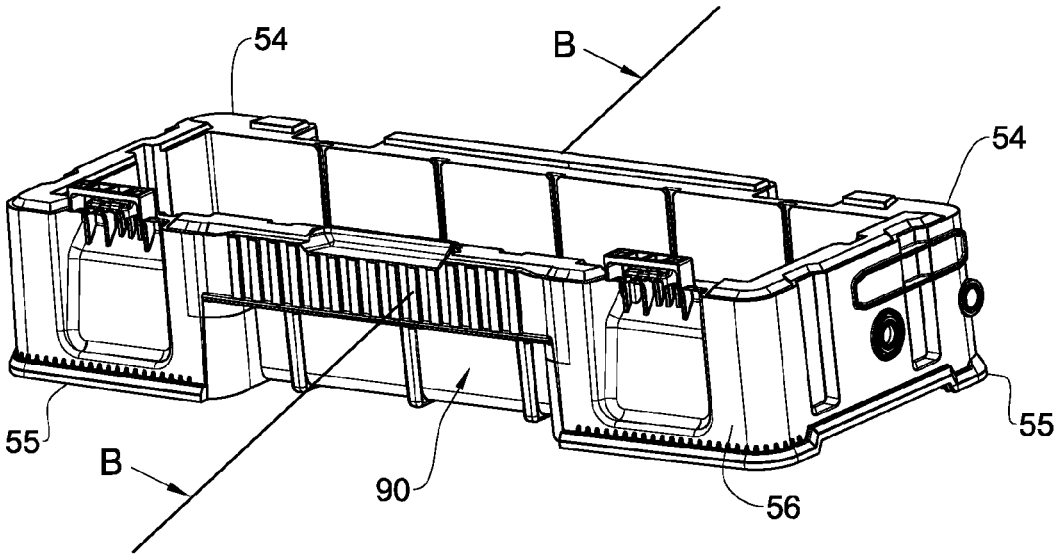
FIG. 3H is a perspective view of a lowermost tray of the cantilever box of FIGS. 1 and 2.

Reference is now made to FIGS. 3H and 31, in which the lowermost tray 50 is illustrated with the second gripping portion 90. FIGS. 3H and 31 illustrate an example of a safe location at which second gripping portion 90 is located in the cantilever box 100. This safe location allows the user to convert the trays from their extended position to their stacked position in a controlled and a safe manner which eliminates or reduces the likelihood of jamming the fingers of the user's second hand between the trays during the conversion between the positions.

Figure 3I:
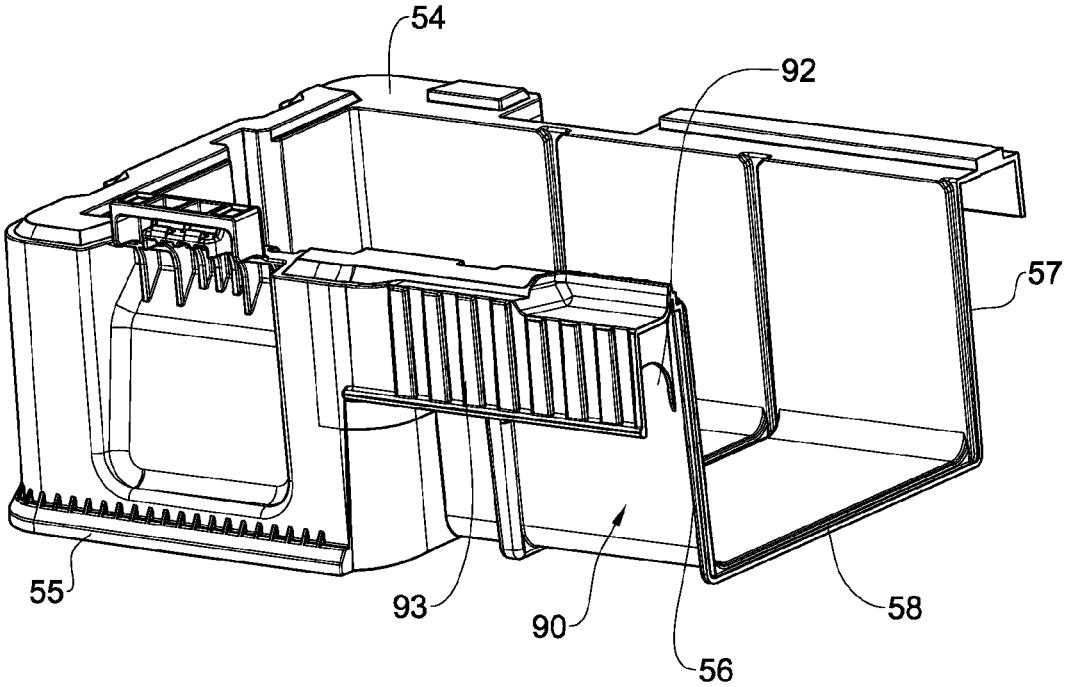
FIG. 3I is a cross-section along line B-B in FIG. 3H.

As shown in FIGS. 3H and 3I, the lowermost tray 50 has a front wall 56, a rear wall 57, a bottom wall 58, a perimetric top edge 54 and a perimetric bottom edge 55. The second gripping portion 90 is formed within the front wall 92. The second gripping portion 90 has a second gripping recess 92 and a second gripping supporting surface 93.

The second gripping portion 90 is configured to be gripped by a second hand of the user, and particularly by the five fingers and the palm of this hand, when the trays are converted from their extended position to their stacked position. This gripping is performed simultaneously the gripping of the first gripping portion 80 by the user's first hand. In particular, the second gripping recess 92 is configured to receive the following four fingers of the user's first hand: the index finger, the middle finger, the ring finger, and the little finger. The second gripping recess 92 is characterized by shape and size which allow accommodation of these four fingers along the length of the second gripping recess 92. While the above four fingers are received within the second gripping recess 92, the thumb and the palm of the user's second hand are configured to engage the second gripping supporting surface 93 so as to provide contra to the pulling force applied to the uppermost tray 10.

Reference is now made to FIGS. 4A, 4B and 5A to 5D which schematically illustrate different views of the cantilever box 100 in its stacked position and its extended position, respectively. The description below is provided for summarizing the operation of the cantilever box 100.

Figure 4A:
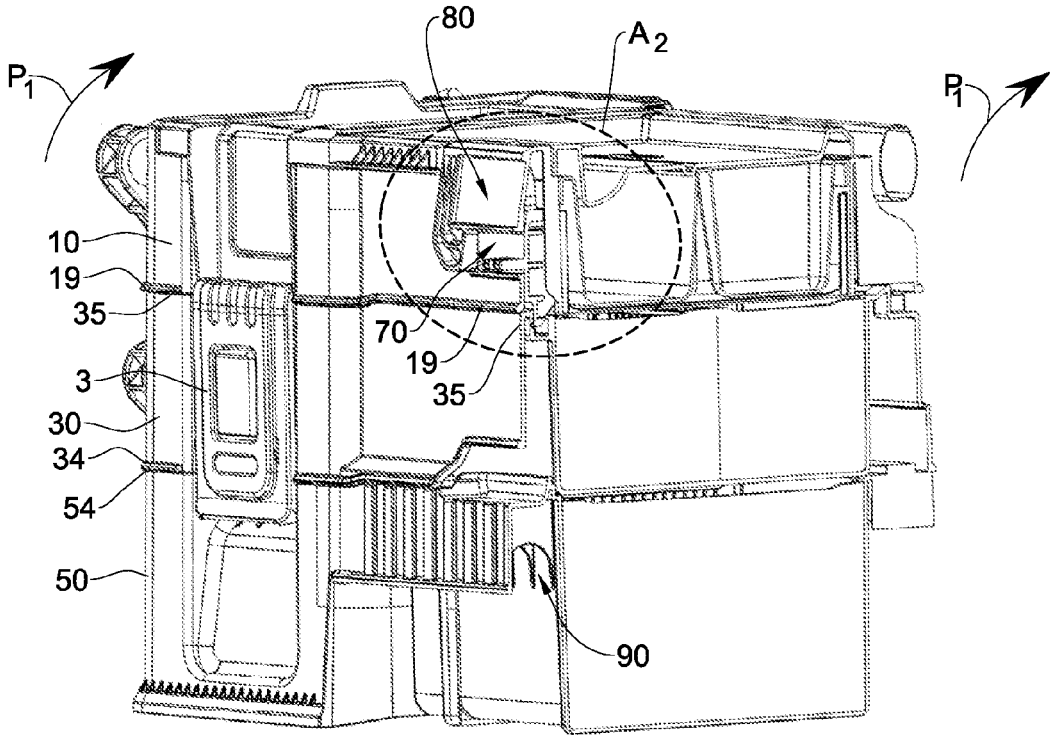
FIG. 4A is a cross-section along line C-C in FIG. 1.
Figure 4B:
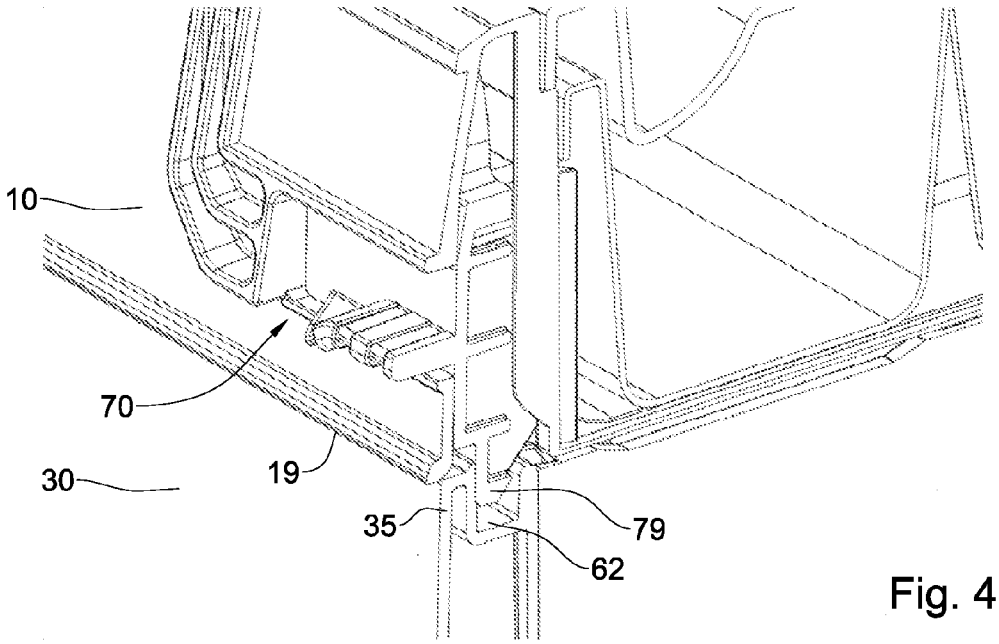
FIG. 4B is an enlarged view of a portion A2 of FIG. 4A.

As shown in FIGS. 4A and 4B, the trays are in their stacked position, and the latch 3 is fixing the uppermost tray 10 to the lowermost tray 50. In this position, the bottom edge 19 of the uppermost tray 10 rests on the top edge 35 of the middle tray 30, and the bottom edge 34 of the middle tray 30 rests on the top edge 54 of the lowermost tray. As shown in FIG. 4B, the securing mechanism 70 is in its normally locked state while the securing protrusion 79 is freely accommodated within the second recess 62.

In order to convert the trays from their stacked position to their extended position, the latches 2 and 3 have to be opened. Afterwards, the user can apply a pulling force on the uppermost tray 10 in the direction of arrow $P_1$ (shown in FIG. 1) by one or two hands of the user. This pulling force can be applied while the user pulls the handle 6 or while he grips the first gripping portion 80. The user can also grip the second gripping portion 90 for holding the whole arrangement on place and preventing it from rolling over.

As shown in FIGS. 5A to 5D, the trays 10, 30 and 50 are locked at their extended position. At this position of the trays, a front portion of the bottom edge 19 rests on the rear edge 39 and a front portion of the bottom edge 34 rests on the rear edge 39. In addition, the securing protrusion 79 is received within the first recess 60, thereby locking the trays in their extended position. If the user will try to convert the trays to their stacked position without switching the securing mechanism to its unlocked state, the securing protrusion 79 will try to move in the direction $P_3$ (shown in FIG. 5D) and will immediately engage an internal wall 61 of the first recess 60. This will arrest the securing protrusion 79 on place, and thereby will prevent displacement of the uppermost tray 10 with respect to the middle tray 30, and consequently the conversion of the trays into their stacked position.

In order to close the cantilever box 100 by converting the trays 10, 30 and 50 to their stacked position in a controlled and a safe manner, the following steps have to be performed by a user:

a. closing the cover 15 (if it was previously opened). As indicated above, the cover can be left opened, and in this case the internal portion 85 will be used instead of the first gripping recess 82 in step 'b' below;
b. gripping the first gripping portion 80 the user's first hand. The gripping is performed by placing the index finger, the middle finger, the ring finger and the little finger within the first gripping recess 82, and by engaging the bottom wall 83 of the thumb supporting element 72 by the user's thumb of the first hand;
c. gripping the second gripping portion 90 by the user's second hand. The gripping is performed by placing the index finger, the middle finger, the ring finger and the little finger within the second gripping recess 92, and by engaging the second gripping supporting surface 93 by the thumb and the palm of the second hand;
d. applying an inwardly biasing force on the bottom wall 83 by the thumb of the first hand in the direction $Z_2$, thereby switching the securing mechanism to its unlocked state and facilitating displacement of the trays from their extended position into their stacked position;
e. while tightly gripping the second gripping portion 90 by the second hand and maintaining the application of the inwardly biasing force on the bottom wall 83, applying a pulling force on the first gripping portion 80 in the direction $P_2$, and thereby displacing the uppermost tray 10 and the middle tray 30 towards the lowermost tray 50 until these trays are brought into their stacked position.

It should be indicated that the above description and its corresponding drawings present only one example of the location of the first gripping portion, the securing mechanism, and the second gripping portion at the cantilever box of the presently disclosed subject matter, for allowing safe and controlled conversion of the trays between their extended and their stacked positions.

The invention claimed is:

1. A cantilever box, comprising:

at least two trays, comprising a lowermost tray and an uppermost tray, interconnected therebetween by cantilever links pivotally secured to said trays, the trays are convertible at least between a stacked position, and an extended position;

a first gripping portion, disposed at the uppermost tray, configured for being gripped by a user for converting the trays between their extended position and their stacked position; and a securing mechanism switchable between a locked state in which when the trays are at their extended position, the securing mechanism is configured for arresting a locking member, thereby locking the trays at their extended position; and an unlocked state in which the securing mechanism is disengaged from said locking member, thereby facilitating displacement of the trays from their extended position into their stacked position;

said securing mechanism being disposed in proximity to the first gripping portion, or integrated therein, so that the user is required to switch the securing mechanism from its locked state to its unlocked state by his first hand while gripping the first gripping portion by the same hand, thereby displacing the uppermost tray for converting the trays from their extended position to their stacked position, wherein said securing mechanism comprises a sliding element having a first end configured with a biasing mechanism for outwardly biasing the sliding element by exerting thereon an outwardly biasing force and thereby causing it to be normally in its locked state; and a second end comprising a securing protrusion configured with a front face.

2. The cantilever box according to claim 1, wherein the uppermost tray is configured with a top wall, a front wall and a bottom wall, said top wall and said front wall being configured with a front edge therebetween, having a longitudinal axis, the first gripping portion being disposed at the middle of the front edge along its longitudinal axis, and wherein the securing mechanism is disposed at the front wall of the uppermost tray.

3. The cantilever box according to claim 1, wherein the first gripping portion has a first gripping recess disposed at the top wall of the uppermost tray.

4. The cantilever box according to claim 1, wherein the first gripping portion has a first gripping recess disposed at the top wall of the uppermost tray, and wherein the first gripping recess is configured with shape and size for accommodating one or more of the following fingers of the user's first hand: index finger, middle finger, ring finger, and little finger.

5. The cantilever box according to claim 1, further comprising a cover member pivotally mounted to the uppermost tray and constitutes a portion of its top wall, and wherein said first gripping recess is disposed at the cover member.

6. The cantilever box according to claim 1, wherein said securing mechanism is normally in its locked state.

7. The cantilever box according to claim 1, wherein the first gripping portion is configured with an interior section, which together with the sliding element constitutes the securing mechanism.

8. The cantilever box according to claim 1, wherein the sliding member further comprises a middle portion configured with a thumb supporting element configured to provide support to a thumb of the user's first hand when switching the securing mechanism from its locked state to its unlocked state by applying an inwardly biasing force on the thumb supporting element.

9. The cantilever box according to claim 1, wherein the securing protrusion is configured to be received at the locking member, and thereby arresting the locking member in the locked state of the securing mechanism.

10. The cantilever box according to claim 1, wherein the securing protrusion normally projects out of the surface of the bottom wall of the uppermost tray.

11. The cantilever box according to claim 1, wherein the sliding element is disposed within the interior section of the first gripping portion, the interior section being configured with a biasing wall configured for engaging the biasing mechanism and providing support thereto for exerting the outwardly biasing force on the sliding element.

12. The cantilever box according to claim 1, wherein the biasing mechanism comprises at least one bendable element.

13. The cantilever box according to claim 1, wherein the sliding element and the biasing mechanism are integrated in a single element.

14. The cantilever box according to claim 1, wherein the sliding element and the biasing mechanism are made of the same material.

15. The cantilever box according to claim 1, further comprising a second gripping portion, disposed at the lowermost tray, configured for being gripped by a user's second hand for providing support to the cantilever box and holding it on place, when the trays are converted between their extended position and their stacked position, and wherein the lowermost tray is configured with a front wall at which the second gripping portion is disposed.

16. The cantilever box according to claim 1, wherein the locking member is disposed at a secondary tray below the uppermost tray.

17. The cantilever box according to claim 1, wherein the locking member is a recess or a fixing element configured to engage with the securing mechanism, and thereby to be arrested by the securing mechanism in its locked state.

18. A cantilever box, comprising:

at least two trays, comprising a lowermost tray and an uppermost tray, interconnected therebetween by cantilever links pivotally secured to said trays, the trays are convertible at least between a stacked position, and an extended position;

a first gripping portion, disposed at the uppermost tray, configured for being gripped by a user for converting the trays between their extended position and their stacked position;

a securing mechanism switchable between a locked state in which when the trays are at their extended position, the securing mechanism is configured for arresting a locking member, thereby locking the trays at their extended position; and an unlocked state in which the securing mechanism is disengaged from said locking member, thereby facilitating displacement of the trays from their extended position into their stacked position;

said securing mechanism being disposed in proximity to the first gripping portion, or integrated therein, so that the user is required to switch the securing mechanism from its locked state to its unlocked state by his first hand while gripping the first gripping portion by the same hand, thereby displacing the uppermost tray for converting the trays from their extended position to their stacked position; and a second gripping portion, disposed at the lowermost tray, configured for being gripped by a user's second hand for providing support to the cantilever box and holding it on place, when the trays are converted between their extended position and their stacked position and wherein the lowermost tray is configured with a front wall at which the second gripping portion is disposed.

19. The cantilever box according to claim 18, wherein the uppermost tray is configured with a top wall, a front wall and a bottom wall, said top wall and said front wall being configured with a front edge therebetween, having a longitudinal axis, the first gripping portion being disposed at the middle of the front edge along its longitudinal axis and wherein the securing mechanism is disposed at the front wall of the uppermost tray.

20. The cantilever box according to claim 18, wherein the first gripping portion has a first gripping recess disposed at the top wall of the uppermost tray.

21. The cantilever box according to claim 18, wherein the first gripping portion has a first gripping recess disposed at the top wall of the uppermost tray, and wherein the first gripping recess is configured with shape and size for accommodating one or more of the following fingers of the user's first hand: index finger, middle finger, ring finger, and little finger.

22. The cantilever box according to claim 18, further comprising a cover member pivotally mounted to the uppermost tray and constitutes a portion of its top wall, and wherein said first gripping recess is disposed at the cover member.

23. The cantilever box according to claim 18, wherein said securing mechanism is normally in its locked state.

24. The cantilever box according to claim 18, wherein the locking member is disposed at a secondary tray below the uppermost tray.

25. The cantilever box according to claim 18, wherein the locking member is a recess or a fixing element configured to engage with the securing mechanism, and thereby to be arrested by the securing mechanism in its locked state.

* * * * *